US008393157B2

(12) United States Patent
Dinu

(10) Patent No.: US 8,393,157 B2
(45) Date of Patent: Mar. 12, 2013

(54) SWOZZLE DESIGN FOR GAS TURBINE COMBUSTOR

(75) Inventor: Constantin Dinu, Greer, SC (US)

(73) Assignee: General Electric Company, Schenectady, NY (US)

( * ) Notice: Subject to any disclaimer, the term of this patent is extended or adjusted under 35 U.S.C. 154(b) by 1666 days.

(21) Appl. No.: 12/016,799

(22) Filed: Jan. 18, 2008

(65) Prior Publication Data

US 2009/0183511 A1 Jul. 23, 2009

(51) Int. Cl.
*F02C 1/00* (2006.01)
*F02G 3/00* (2006.01)

(52) U.S. Cl. ..... 60/748; 60/740; 60/742; 60/746; 60/737; 239/399

(58) Field of Classification Search ..... 60/740, 60/742, 746, 747, 748, 737; 239/222.11, 239/223, 399, 423, 424, 427.3, 429–434, 239/478, 487

See application file for complete search history.

(56) References Cited

U.S. PATENT DOCUMENTS 4,364,522 A * 12/1982 Reider ..... 239/399
5,540,406 A * 7/1996 Occhipinti ..... 244/200
6,438,961 B2 * 8/2002 Tuthill et al. ..... 60/776

* cited by examiner

*Primary Examiner* — William H Rodriguez
*Assistant Examiner* — Carlos A Rivera
(74) *Attorney, Agent, or Firm* — Cantor Colburn LLP

(57) ABSTRACT

Disclosed is a fuel nozzle for a combustor of a gas turbine engine includes a nozzle inlet, a combustion area and a swirler disposed between the nozzle inlet and combustion area. The swirler includes a plurality of swirler vanes, each swirler vane capable of creating a pressure difference in fluid flow through the swirler between a pressure side and suction side of the swirler vane. The swirler further includes at least one through airflow hole located in at least one swirler vane of the plurality of swirler vanes. The at least one through airflow hole is capable of utilizing the pressure difference between the pressure side and suction side to promote fluid flow through the at least one airflow hole. Also disclosed is a method for operating a combustor.

10 Claims, 3 Drawing Sheets

SWOZZLE DESIGN FOR GAS TURBINE COMBUSTOR

BACKGROUND

The subject invention relates generally to gas turbines. More particularly, the subject invention relates to fuel nozzles for gas turbine engines.

Gas turbines typically include a quantity of fuel nozzles (or swozzles) in a combustor section of the gas turbine. Each nozzle is a component having one or more passages for delivering a mixture of fuel and air to a combustion chamber for ignition. A fuel nozzle often includes a swirler to improve mixing of the fuel and air into a consistent, homogeneous mixture prior to ignition. The swirler includes a plurality of vanes extending from the nozzle and having an aerodynamic profile. The swirler vanes often include passages which provide fuel to fuel holes on a surface of the swirler vanes. As fuel exits the fuel holes, it mixes with fluid, typically air, passing the swirler vanes. Size and space limitations usually result in swirler vanes having an abrupt turn near the trailing edge of the swirler vane that may produce flow separations in the swirler or downstream of the swirler which can lead to detrimental effects on fuel nozzle performance, for example, flame holding. Typically, to solve flow problems such as the above, the vane profile is modified requiring new casting processes and casting tooling for each iteration, modifying the pattern of fuel holes on the vanes which may have detrimental effects on, for example, mixing efficiency and thus nozzle performance.

BRIEF DESCRIPTION OF THE INVENTION

A fuel nozzle for a combustor of a gas turbine engine includes a nozzle inlet, a combustion area and a swirler disposed between the nozzle inlet and combustion area. The swirler includes a plurality of swirler vanes, each swirler vane capable of creating a pressure difference in fluid flow through the swirler between a pressure side and suction side of the swirler vane. The swirler further includes at least one through airflow hole located in at least one swirler vane of the plurality of swirler vanes. The through airflow hole is capable of utilizing the pressure difference between the pressure side and suction side to promote flow through the at least one airflow hole.

A method for operating a combustor of a gas turbine engine includes urging a fluid flow into a nozzle inlet, urging fuel into the fluid flow and flowing the fuel and fluid flow into a swirler, the swirler having a plurality of swirler vanes, thus mixing the fuel into the fluid flow. The method further includes creating a pressure difference in the fluid flow through the swirler between a pressure side and a suction side of each swirler vane of the plurality of swirler vanes and flowing at least a portion of the fluid through at least one through airflow hole in at least one swirler vane of the plurality of swirler vanes, thus reducing the pressure difference between the pressure side and the suction side of the swirler vane. The mixture of fuel and fluid flow is ignited in a combustion area.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
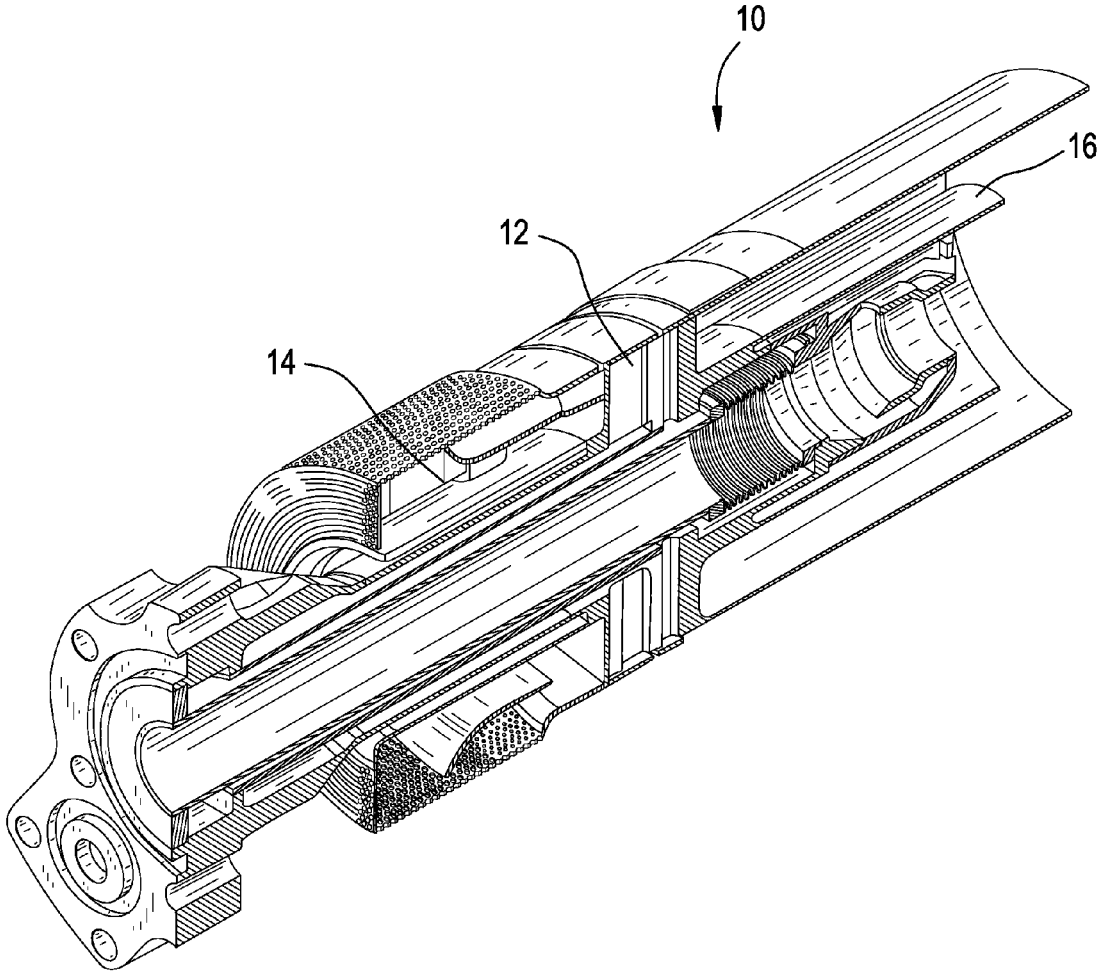
FIG. 1 is a cross section view of an embodiment of a fuel nozzle for a gas turbine engine.
Figure 2:
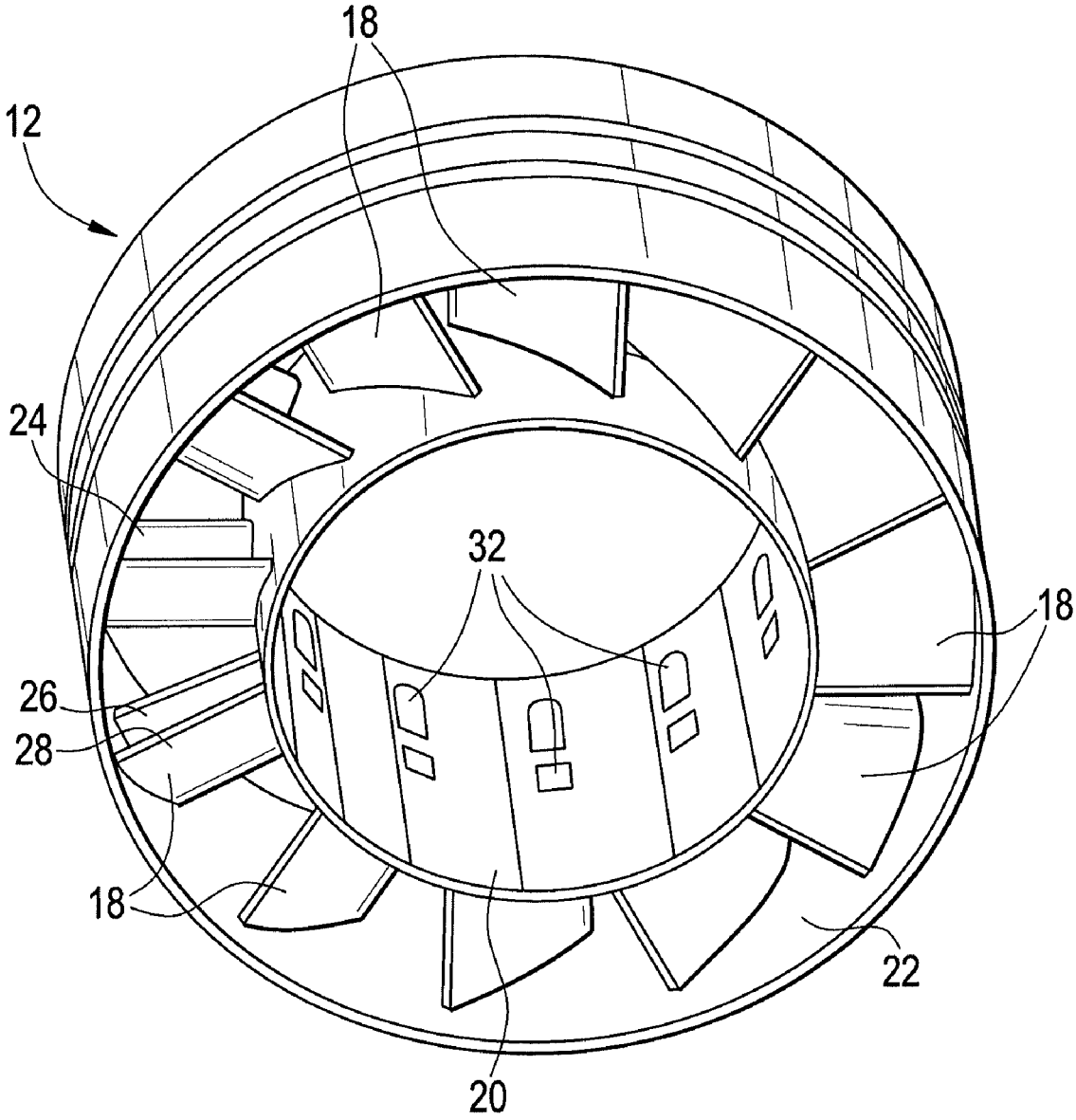
FIG. 2 is a perspective view of a swirler for the fuel nozzle of FIG. 1.

Shown in FIG. 1 is a portion of a fuel nozzle 10 including a swirler 12. The swirler is configured and disposed to receive a fluid flow, normally air, from a nozzle inlet 14 and mix the air with fuel into an air/fuel mix. The air/fuel mix then proceeds downstream where it is ignited in a combustion area 16. As best shown in FIG. 2, the swirler 12 includes a plurality of swirler vanes 18 arranged circumferentially around a center body 20 and extending to a shroud 22. The swirler 12 of the embodiment of FIG. 1 is, in one embodiment, produced as a casting, but other methods of fabrication including for example, welding or machining, are contemplated within the scope of the present disclosure.

Figure 3:
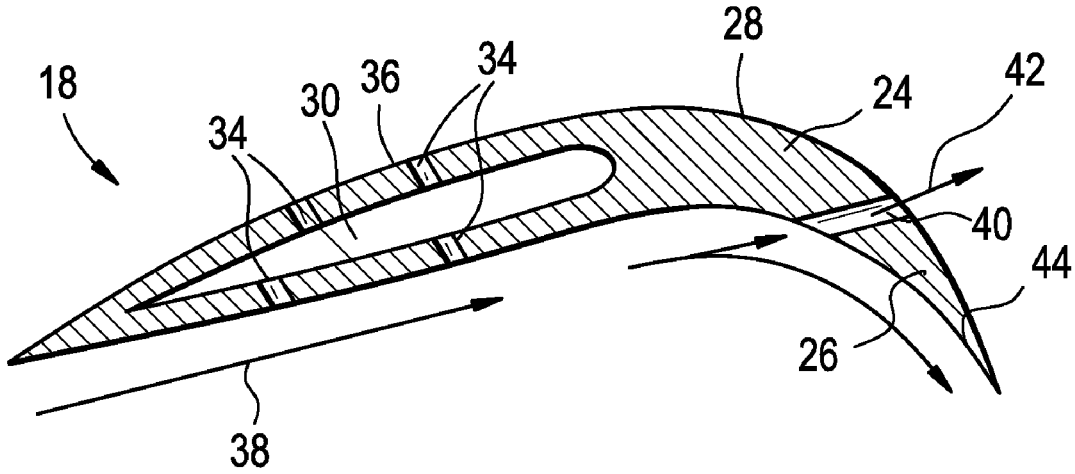
FIG. 3 is a cross-section view of an embodiment of a swirler vane of the swirler of FIG. 2.

The center body 20 is substantially annular in cross-section and is capable of carrying a fluid, for example, fuel therethrough. The plurality of swirler vanes 18 include turning sections 24. The turning sections 24 are capable of turning or inducing swirl in a fluid flow, which in some embodiments is air, flowing past the swirler vanes 18. A curvature of the turning section 24 creates a pressure differential between a pressure side 26 and a suction side 28 of the swirler vane 18. The swirler vane 18 may have one or more internal plenums 30 as best shown in FIG. 3. The plenums 30 are connected to the center body 20 at one or more center body holes 32 and are configured to be capable of flowing fuel from the center body 20 through the one or more plenums 30 and exiting the plenums 30 through one or more fuel holes 34 disposed at an axial portion 36 of the swirler vanes 18. Fuel exiting the fuel holes 34 enters the airflow, shown by arrows 38, past the swirler vanes 18 and is mixed with the airflow 38.

The swirler vanes 18 include at least one airflow hole 40. The airflow holes 40 are disposed in the turning section 24 and are configured as through-holes extending through a solid cross section of swirler vane 18. The at least one airflow hole 40 allows transfer of some of the airflow from the pressure side 26 to the suction side 28 as shown by arrows 42. The airflow transfer prevents separation of an aerodynamic boundary layer from the turning section 24 thus preventing flame holding, and/or other detrimental effects on combustor performance. In the embodiment shown in FIG. 2, the at least one airflow hole 40 is disposed near a trailing edge 44 of the swirler vane 18, however, the at least one airflow holes 40 effectively prevents separation if the at least one airflow hole 40 is located within or downstream of the turning section 24.

Figure 4:
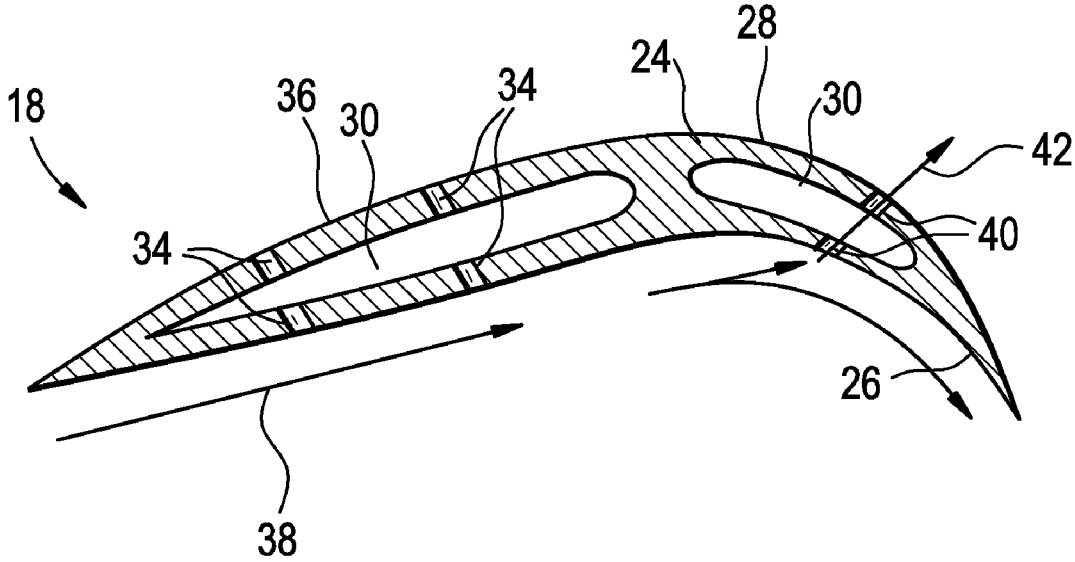
FIG. 4 is a cross-section view of another embodiment of a swirler vane of the swirler of FIG. 2.

In some embodiments, as shown in FIG. 4, at least one plenum 30 extends into the turning section 24, and at least one airflow hole 40 is disposed at a plenum 30. In these embodiments, fuel will be discharged into the flow from the plenum 30 as the flow passes through the at least one airflow hole 40. The at least one airflow hole 40 in this embodiment provides prevention of boundary layer separation as described above and also improves a premixing efficiency of the fuel and air because of the discharge of fuel into the air flow in the at least one airflow hole 40. Fuel pressure in the plenum 30 may be increased to prevent airflow from accumulating in the plenum 30.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel nozzle for a combustor of a gas turbine engine comprising:

a nozzle inlet;

a combustion area; and a swirler disposed between the nozzle inlet and combustion area, the swirler including:

a plurality of swirler vanes, each swirler vane creating a pressure difference in fluid flow between a pressure side and suction side of the swirler vane; and at least one through hole disposed in at least one swirler vane of the plurality of swirler vanes, the at least one through hole utilizing the pressure difference to promote fluid flow through the at least one through hole to prevent separation of an aerodynamic boundary layer from the at least one swirler vane, the at least one swirler vane including a downstream turning section having a reduced radius of curvature relative to an upstream portion of said at least one swirler vane to create the pressure difference, the at least one through hole disposed at or downstream of the turning section, the at least one through hole is fluidly connected through an internal plenum and is flowing fluid from the pressure side to the suction side of the at least one swirler vane.

2. The fuel nozzle of claim 1 wherein the at least one swirler vane of the plurality of swirler vanes includes a second internal plenum.

3. The fuel nozzle of claim 2 wherein the at least one swirler vane includes a second fuel hole flowing fuel out of the second internal plenum into the fluid flow.

4. The fuel nozzle of claim 1 wherein the through hole is allowing mixing of fuel from the said internal plenum with the fluid flow as fluid passes through the through hole.

5. The fuel nozzle of claim 1 wherein the fluid is air.

6. A method for operating a combustor comprising:

urging a fluid flow into a nozzle inlet;

urging fuel into the fluid flow;

flowing the fuel and fluid flow into a swirler, the swirler comprising a plurality of swirler vanes, thus mixing the fuel into the fluid flow;

creating a pressure difference in the fluid flow through the swirler between a pressure side and a suction side of each swirler vane of the plurality of swirler vanes, at least one swirler vane of the plurality of swirler vanes having a downstream turning section defined by a reduced radius of curvature relative to an upstream portion of said at least one swirler vane to create the pressure difference;

flowing at least a portion of the fluid through at least one through hole in the at least one swirler vane of the plurality of swirler vanes disposed at or downstream of the turning section to prevent separation of an aerodynamic boundary layer from the at least one swirler vane, the at least one through hole is fluidly connected through an internal plenum and is flowing fluid from the pressure side to the suction side of the at least one swirler vane; and igniting the mixture of fuel and fluid flow in a combustion area.

7. The method of claim 6 wherein fuel is added to the fluid flow from a second internal plenum in the at least one swirler vane of the plurality of swirler vanes.

8. The method of claim 7 wherein fuel exits the second internal plenum via a second fuel hole disposed in the at least one swirler vane of the plurality of swirler vanes.

9. The method of claim 8 wherein fuel is added to the fluid as the fluid flows through the at least one through hole fluidly connected through the internal plenum.

10. The method of claim 6 wherein the fluid is air.

* * * * *